United States Patent [19]

Mühlbauer et al.

[11] 4,371,100

[45] Feb. 1, 1983

[54] ADJUSTABLE CARRYING-TOWER ARRANGEMENT FOR METALLURGICAL VESSELS

[75] Inventors: Gerhard Mühlbauer, Steyr; Herbert Höller, Schwanenstadt, both of Austria

[73] Assignee: Voest-Alpine Aktiengesellschaft, Linz, Austria

[21] Appl. No.: 229,953

[22] Filed: Jan. 30, 1981

[30] Foreign Application Priority Data

Mar. 5, 1980 [AT] Austria ..... 1203/80

[51] Int. Cl.[3] ..... B22D 41/00

[52] U.S. Cl. ..... 222/591; 294/67 DC; 164/438

[58] Field of Search ..... 164/335, 336, 337, 437, 164/438; 294/67 DC, 73; 222/590, 591, 604, 605, 607

[56] References Cited

U.S. PATENT DOCUMENTS

| | | | |
|---|---|---|---|
| 3,552,902 | 1/1971 | Schoffmann et al. | 164/438 |
| 4,124,152 | 11/1978 | Fioravazzi | 164/337 X |
| 4,270,738 | 6/1981 | Dangeleit et al. | 164/335 X |

*Primary Examiner*—David A. Scherbel

*Attorney, Agent, or Firm*—Brumbaugh, Graves, Donohue & Raymond

[57] ABSTRACT

A carrying tower for metallurgical vessels includes at least one carrying arm that projects from a supporting column and possesses two supporting arms laterally encompassing the metallurgical vessel. Each of the supporting arms is provided with at least two differing supports that are exchangeable for one another and into which the carrying means of differing metallurgical vessels are fittable.

6 Claims, 6 Drawing Figures

ADJUSTABLE CARRYING-TOWER ARRANGEMENT FOR METALLURGICAL VESSELS

Figure 1:
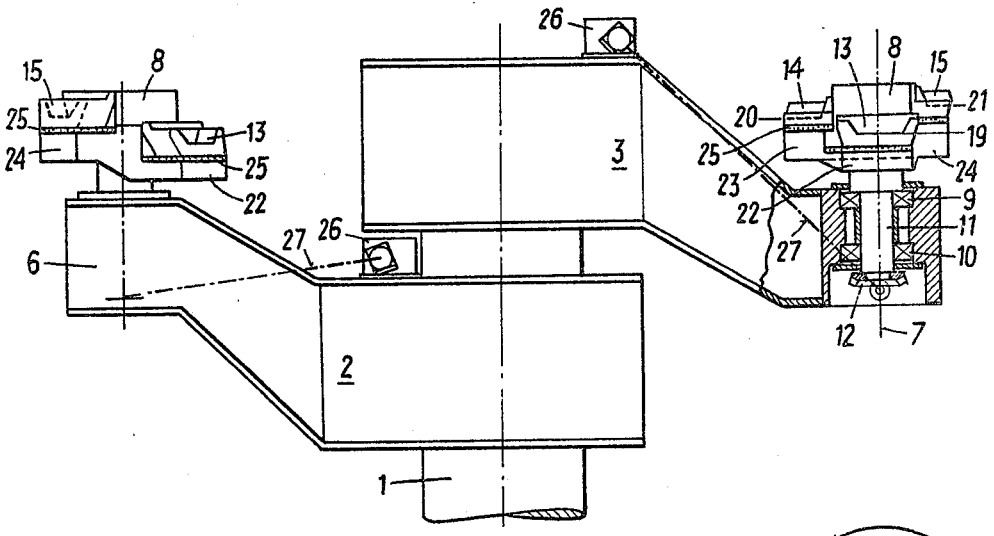

The invention relates to a carrying tower for metallurgical vessels, in particular for casting ladles at a continuous casting plant, comprising at least one carrying arm projecting from a supporting column and including two supporting arms which laterally encompass the metallurgical vessel and on which supports for carrying means provided at the metallurgical vessel are arranged.

In metallurgical plants metallurgical vessels, in particular casting ladles, of different dimensions or different structural designs are usually in operation for one and the same purpose. In particular with continuous casting the metallurgical vessels (casting ladles) that serve as reservoirs are carried by a carrying tower with a projecting carrying arm. The carrying arm comprises two supporting arms that encompass the metallurgical vessel laterally and on which a support for a carrying means provided at the metallurgical vessel, such as a supporting bracket of a casting ladle, is provided. With such a carrying tower, one is bound to the utilization of metallurgical vessels of certain dimensions and designs which are determined by the distance between the two supports provided on the supporting arms, their cross-sectional shapes, as well as their altitudes. This is disadvantageous with respect to a continuously running casting operation, in particular with continuous casting. A further disadvantage resides in the fact that it is thereby not possible to optimally apply and utilize the movable cranes of different construction heights and carrying powers that are usually used for the transportation of vessels in metallurgical plants.

The invention therefore has as its object to provide a carrying tower of the initially defined kind which makes possible the utilization of different metallurgical vessels at one and the same carrying arm of the carrying tower.

This object is achieved according to the invention in that each supporting arm is provided with at least two different mutually exchangeable supports into which carrying means of differing metallurgical vessels are fittable.

According to a preferred embodiment, the exchangeable supports of each supporting arm are arranged on a carrying body which is rotatable about a vertical axis provided on the respective supporting arm.

In order to be able to use, in continuous casting plants, also casting ladles that differ in height, wherein the distance between the bath level in the vessel arranged below the casting ladle and the outlet of the casting ladle always is to be the same—with the altitude of the casting ladles remaining unchanged—, the supports of each supporting arm suitably are arranged on the carrying body at different height levels.

According to another preferred embodiment, the supports of each supporting arm have cross-sectional shapes that differ from one another and are engageable with correspondingly differing carrying means of the metallurgical vessels.

In order to be able to use casting ladles having different diameters, suitably the supports of each supporting arm are arranged on the carrying body at different distances from the rotation axis of the supporting body.

The drive for the rotatable carrying bodies may be designed in various manners, wherein it has proved particularly advantageous if a motor is mounted on the carrying arm, which motor is connected, via driving shafts, with the carrying bodies for the synchronous rotation of the same.

Figure 2:
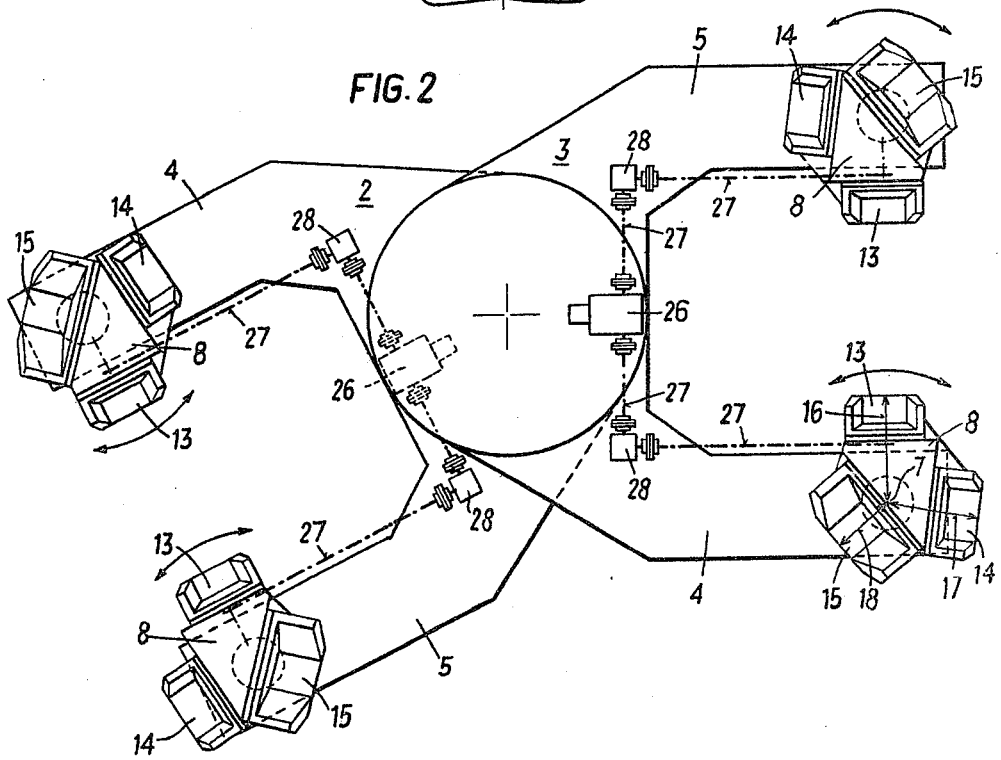
Figure 3:
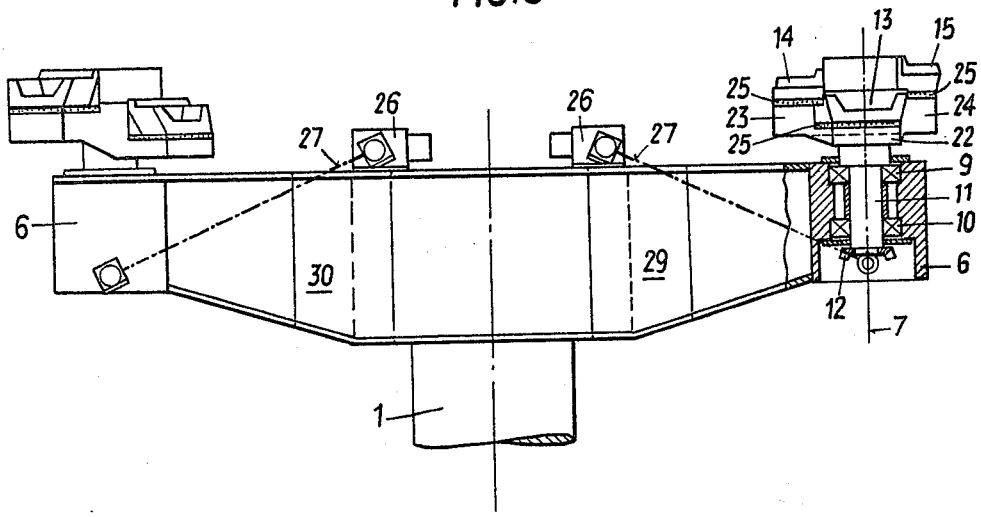
Figure 4:
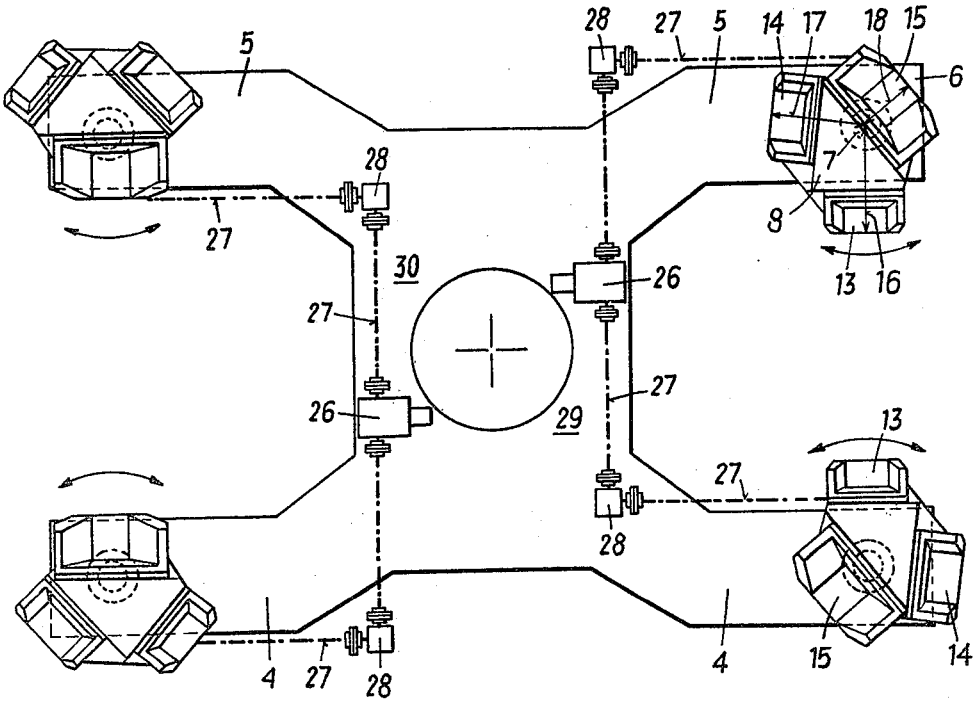
Figure 5:
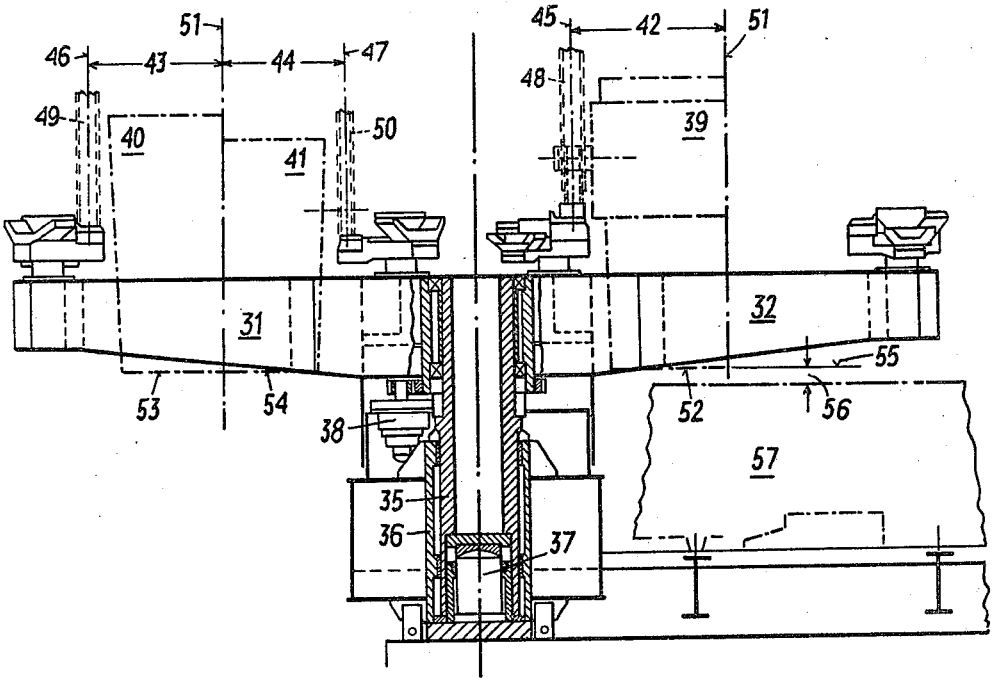
Figure 6:
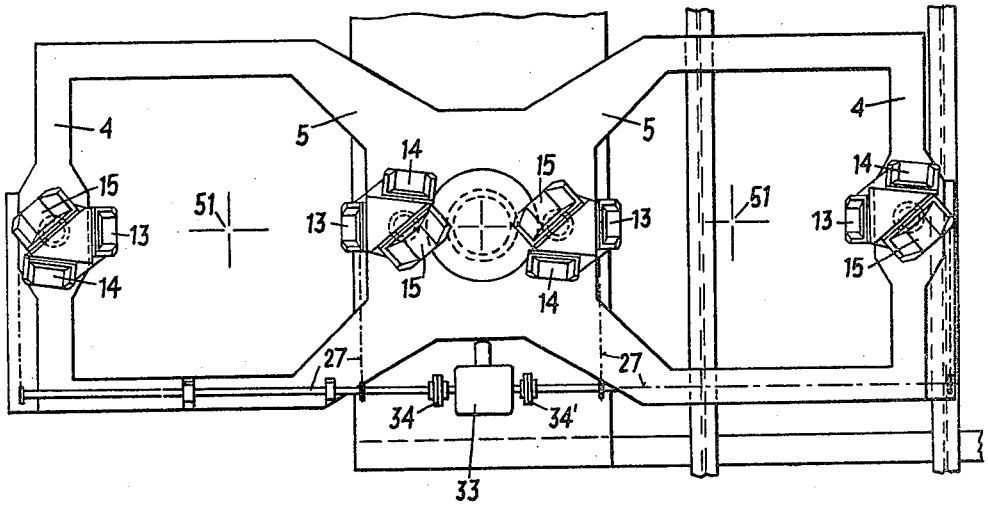

The invention will now be explained in more detail by way of three embodiments with reference to the accompanying drawings, wherein:

FIGS. 1, 3 and 5 each are one embodiment of a carrying tower in a partially sectioned side view, and FIGS. 2, 4 and 6 are the pertaining top views of the carrying towers illustrated in FIGS. 1, 3 and 5, respectively.

With the embodiment illustrated in FIGS. 1 and 2, the carrying tower comprises two cranked carrying arms 2, 3 which are pivotable independently of each other about a column 1. Each of the carrying arms 2, 3 possesses two supporting arms 4, 5, which laterally encompass a metallurgical vessel (not illustrated) and on whose front ends 6 a carrying body 8 is each mounted to be rotatable about a vertical axis 7. Each of these carrying bodies 8 comprises a pin 11 mounted in the supporting arm 4, 5 by means of an axial-radial bearing 9 and a radial bearing 10, which pin, on its lower end, is provided with a toothed wheel 12 rigidly fastened to it. In the top view, each carrying body 8 is approximately triangularly designed. On each of the three sides of the carrying body a ladle seat 13, 14, 15 is provided, the ladle seats of each carrying body differing from one another in three respects: The ladle seats 13, 14, 15 have different cross-sectional shapes, they are arranged at different distances 16, 17, 18 from the axis 7 of the carrying body 8 (FIG. 2), and, furthermore, they are arranged on the carrying body 8 at different height levels 19, 20, 21, as can be seen from FIG. 1. A shock-absorbing element 25 is each installed between the ladle seats 13, 14, 15 and consoles 22, 23, 24 provided on the carrying body 8 and designed to be integral with the same for supporting these ladle seats.

In order to be able to rotate the carrying bodies 8 in a simple manner, a motor 26 is mounted on each carrying arm 2, 3, which motor is connected with both carrying bodies 8 of the carrying arms 2, 3 by means of schematically illustrated driving shafts 27 and corner gears 28, the last driving shaft engaging with a toothed wheel in the toothed wheel 12 mounted on the lower end of the pin 11. As can be seen from FIG. 2, the carrying bodies 8 are equally designed, so that they can be rotated synchronously in order to pivot two corresponding ladle seats 13, 14, 15 inwardly, i.e. into between the supporting arms 4, 5.

According to the embodiment of FIGS. 1 and 2, it is possible to use three different casting ladles on one and the same carrying arm 2, 3 of the carrying tower, which casting ladles may differ with respect to their supporting brackets, their diameters and their heights. It is only necessary to turn inwardly, i.e. into an aligning position, the pair of seats 13, 14, 15 that corresponds to the casting ladle used.

With the embodiments represented in FIGS. 3 and 4, and 5 and 6, respectively, the two carrying arms 29, 30, and 31, 32, respectively, are pivotable not independently of each other, but only commonly together, due to their integral design. The embodiment according to FIGS. 3 and 4 also comprises a separate motor 26 for each carrying arm.

With the embodiment illustrated in FIGS. 5 and 6, a single motor 33 is provided for rotating all of the carrying bodies 8 of the two carrying arms 31, 32, wherein it is possible to always rotate only one pair of carrying bodies of a carrying arm 31 or 32 by control couplings 34, 34'. By setting one of the control couplings 34 or 34' into operation, the other automatically will be set out of operation.

The carrying tower according to FIGS. 5 and 6, with its column 35, is inserted in a guiding column 36 surrounding the former, and is liftable and lowerable by means of a lifting cylinder 37. The drive for pivoting the carrying arms is denoted by 38.

In FIG. 5, ladles 39, 40, 41 that differ in size are illustrated in broken lines, as they may be used with this carrying tower. The distances 42, 43, 44 between the central lines 45, 46, 47 of the carrying means 48, 49, 50 of these differing ladles 39, 40, 41 and their central lines 51 differ from one another. From this FIG. 5, it can furthermore be seen that the bottoms 52, 53, 54 of these differing ladles 39, 40, 41 are at the same height 55, so that the distance 56 between the tundish 57 being below the respectively used casting ladle 39 or 40 or 41 and the bottom 52 or 53 or 54 of the casting ladle (with the carrying arms 31, 32 being at the same height level) is always the same.

The invention is not limited to the embodiments illustrated, but can be modified in various aspects. Thus, it is also possible to provide only two, or more than three, ladle seats on each carrying body. The rotation drive for the carrying bodies may also be effected manually. But it may also be effected in an electric-mechanical, hydraulic-mechanical or pneumatic-mechanical manner.

What we claim is:

1. In a carrying-tower arrangement for a metallurgical vessel, in particular for a casting ladle of a continuous casting plant, of the type including a supporting column, at least one carrying arm projecting from said supporting column and having two supporting arms adapted for laterally encompassing said metallurgical vessel, carrying means provided on said metallurgical vessel, and supports arranged on said two supporting arms for said carrying means, the improvement which is characterized in that at least two supports are arranged on each of said two supporting arms, which at least two supports differ from one another, are exchangeable for one another, and into which the carrying means of differing metallurgical vessels are fittable.

2. A carrying-tower arrangement as set forth in claim 1, wherein a vertical axis is provided on each of said two supporting arms, and a carrying body is provided on each of said two supporting arms so as to be rotatable about said vertical axis and accommodating said at least two supports of the respective one of said two supporting arms.

3. A carrying-tower arrangement as set forth in claim 2, wherein said at least two supports of each of said two supporting arms are arranged on said carrying body at different height levels.

4. A carrying-tower arrangement as set forth in claim 2, wherein said at least two supports of each of said two supporting arms have different cross-sections and said carrying means of said differing metallurgical vessels have different shapes that correspond to said different cross-sections of said at least two supports so as to be engageable therewith.

5. A carrying-tower arrangement as set forth in claim 2, wherein said at least two supports of each of said two supporting arms are arranged on said carrying body at different distances from said vertical axis.

6. A carrying-tower arrangement as set forth in claim 2, further comprising a motor mounted on said at least one carrying arm, and driving shafts for connecting said motor with said carrying body of each of said two supporting arms for a synchronous movement thereof.

* * * * *